US008656986B2

(12) United States Patent
Yuan et al.

(10) Patent No.: US 8,656,986 B2
(45) Date of Patent: Feb. 25, 2014

(54) FIN, HEAT EXCHANGER AND HEAT EXCHANGER ASSEMBLY

(75) Inventors: Gao Yuan, Zhejiang (CN); Lin-jie Huang, East Amherst, NY (US)

(73) Assignee: Danfoss Sanhua (Hangzhou) Micro Channel Heatexchange Co., Ltd., Zhejiang (CN)

( * ) Notice: Subject to any disclaimer, the term of this patent is extended or adjusted under 35 U.S.C. 154(b) by 963 days.

(21) Appl. No.: 12/759,242

(22) Filed: Apr. 13, 2010

(65) Prior Publication Data

US 2010/0258286 A1 Oct. 14, 2010

(30) Foreign Application Priority Data

Apr. 13, 2009 (CN) ..... 2009 1 0133642

(51) Int. Cl.
*F28D 1/02* (2006.01)
*F28F 1/30* (2006.01)

(52) U.S. Cl.
USPC ..... 165/152; 185/182

(58) Field of Classification Search
CPC .... B21D 13/04; B21D 53/022; B21D 53/025; F28F 1/126; F28F 1/128
USPC ..... 165/151, 152, 181, 182; 29/890.047
See application file for complete search history.

(56) References Cited

U.S. PATENT DOCUMENTS

| | | | | |
|---|---|---|---|---|
| 5,271,458 | A * | 12/1993 | Yamamoto et al. | 165/152 |
| 5,529,116 | A * | 6/1996 | Sasaki et al. | 165/144 |
| 5,679,106 | A * | 10/1997 | Ohno et al. | 492/1 |
| 5,787,972 | A * | 8/1998 | Beamer et al. | 165/152 |
| 6,074,507 | A * | 6/2000 | Sukenik | 156/205 |
| 6,213,196 | B1 * | 4/2001 | Ozaki et al. | 165/140 |
| 7,231,965 | B2 * | 6/2007 | Shimoya et al. | 165/151 |
| 2005/0229630 | A1 * | 10/2005 | Richter et al. | 62/507 |
| 2007/0199686 | A1 * | 8/2007 | Okinotani et al. | 165/152 |

FOREIGN PATENT DOCUMENTS

JP 2000193388 A * 7/2000

* cited by examiner

*Primary Examiner* — Tho V Duong
(74) *Attorney, Agent, or Firm* — McCormick, Paulding & Huber LLP

(57) ABSTRACT

The present invention discloses a fin of heat exchanger comprising a straight segment; a substantially-circular arc segment having a radius of R; and a substantially-circular arc transition segment connected between the straight segment and the substantially-circular arc segment and having a radius of r, wherein R>r. According to the present invention, after being assembled and welded to the heat exchanger, the substantially-circular arc segment is relatively easy to deform, and the shapes of the straight segment and substantially-circular arc transition segment are substantially unchanged. Therefore, the deformation of the fin is regular and easy to control. The arranging density of the fin in the heat exchanger is uniform, and the shape of the fin can meet the design requirements. In addition, the shape stability and the heat transfer coefficient of the fin are high.

6 Claims, 6 Drawing Sheets

FIN, HEAT EXCHANGER AND HEAT EXCHANGER ASSEMBLY

CROSS REFERENCE TO RELATED APPLICATIONS

This application is entitled to the benefit of and incorporates by reference essential subject matter disclosed in Chinese Patent Application No. 200910133642.8 filed on Apr. 13, 2009.

BACKGROUND OF THE INVENTION

1. Field of the Invention

The present invention generally relates to a fin, a heat exchanger having the fin, and a heat exchanger assembly, and more particularly, to a corrugated fin having a substantially sinusoidal shape, a micro-channel heat exchanger and a heat exchanger assembly comprising a plurality of micro-channel heat exchangers.

2. Description of the Related Art

Conventional corrugated fins having a substantially sinusoidal shape are widely used in heat exchangers. Conventional corrugated fins generally comprise a straight segment and a circular arc shaped root segment which are connected with each other. During manufacturing of the heat exchanger, as shown in FIGS. 10 and 11, the fin 1' is disposed horizontally or vertically between adjacent flat tubes 2' of the micro-channel heat exchanger. During assembling, the fin 1' is pressed against two adjacent flat tubes 2 of the heat exchanger so that the fin 1' will be deformed. Generally, the fin is deformed at the circular arc shaped root segment and/or the connection point between the circular arc shaped root segment and the straight segment, as shown in FIGS. 10 and 11, in which FIG. 10 shows the state before the fin 1' is deformed and FIG. 11 shows the state after the fin 1' is deformed.

Since the circular arc shaped root segment and the straight segment are directly connected to each other, the circular arc shaped root segment is difficult to be pressed. Therefore, the deformation of the circular arc shaped root segment and/or the connection point is irregular and difficult to control, and the fins 1' are different from each other in deformation. Consequently, the arranging density of the fins 1' in the heat exchanger is not uniform and the shape of the fins 1' cannot meet the design requirements.

For example, as shown in FIG. 11, after the fin 1' is welded onto the flat tube 2', the shapes of an area A' surrounded by two adjacent straight segments of the fin 1' and the tubes 2' is irregular and different from one another. Therefore, the heat transfer coefficient of the fin 1' on the air side is decreased, and thus the heat exchanging performance is deteriorated. In addition, the appearance of the heat exchanger is untidy.

SUMMARY OF THE INVENTION

The embodiments of the present invention are directed to solve at least one of the problems existing in the prior art.

A first aspect of the present invention is directed to providing a fin, after being assembled and welded to the heat exchanger, where the deformation of the fin is regular and easy to control, and the arranging density of the fin in the heat exchanger is uniform. In addition, the fin is stable in shape and tidy in appearance with a high heat transfer coefficient.

An embodiment of the first aspect of the present invention provides a fin for a heat exchanger, comprising: a straight segment; a substantially-circular arc segment having a radius of R; and a substantially-circular arc transition segment connected between the straight segment and the substantially-circular arc segment and having a radius of r, in which R>r.

Since the radius R of the substantially-circular arc segment is larger than the radius r of the substantially-circular arc transition segment, after being assembled and welded to the heat exchanger, the substantially-circular arc segment is relatively easy to deform, and the shapes of the straight segment and substantially-circular arc transition segment are substantially unchanged. Therefore, the deformation of the fin is regular and easy to control. The arranging density of the fin in the heat exchanger is uniform, and the shape of the fin can meet the design requirements. In addition, the shape stability and the heat transfer coefficient of the fin are high.

A second aspect of the present invention is directed to providing a heat exchanger comprising the fin according to the first aspect of the present invention, where the arranging density of the fin in the heat exchanger is uniform and the heat transfer coefficient of the fin is high, so that the heat exchanging performance of the heat exchanger is improved.

An embodiment of the second aspect of the present invention provides a heat exchanger, comprising: a first header formed with an inlet; a second header, in which one of the first and second headers is formed with an outlet; heat transfer tubes, in which two ends of each heat transfer tube are connected to and communicate with the first and second headers respectively; and fins, in which each fin is disposed between two adjacent heat transfer tubes and includes: a straight segment; a substantially-circular arc segment having a radius of R; and a substantially-circular arc transition segment connected between the straight segment and the substantially-circular arc segment and having a radius of r, in which R>r.

A third aspect of the present invention is directed to providing a heat exchanger assembly comprising a plurality of heat exchangers according to the second aspect of the present invention.

An embodiment of the third aspect of the present invention provides a heat exchanger assembly, comprising a plurality of heat exchangers, in which each heat exchanger comprises: a first header formed with an inlet; a second header, in which one of the first and second headers is formed with an outlet; heat transfer tubes, in which two ends of each heat transfer tube are connected to and communicate with the first and second headers respectively; and fins, in which each fin is disposed between two adjacent heat transfer tubes and includes: a straight segment; a substantially-circular arc segment having a radius of R; and a substantially-circular arc transition segment connected between the straight segment and the substantially-circular arc segment and having a radius of r, in which R>r.

The above summary of the present invention is not intended to describe each disclosed embodiment or every implementation of the present invention. The figures and detailed description which follow more particularly exemplify illustrative embodiments.

Additional aspects and advantages of the embodiments of present invention will be given in part in the following descriptions, become apparent in part from the following descriptions, or be learned from the practice of the embodiments present invention.

BRIEF DESCRIPTION OF THE DRAWINGS

These and other aspects and advantages of the invention will become apparent and more readily appreciated from the following descriptions taken in conjunction with the drawings, in which.

DETAILED DESCRIPTION OF EMBODIMENTS OF THE INVENTION

Figure 1:
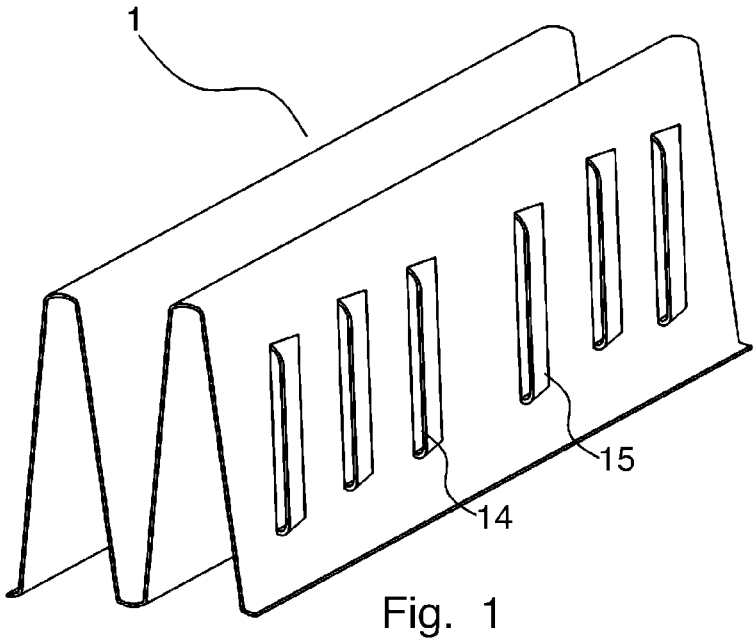
FIG. 1 is a perspective view of a part of a fin according to an embodiment of the present invention before being assembled and welded to a heat exchanger.

Reference will be made in detail to embodiments of the present invention. The embodiments described herein with reference to drawings are explanatory, illustrative, and used to generally understand the present invention. The embodiments shall not be construed to limit the present invention. The same or similar elements and the elements having same or similar functions are denoted by like reference numerals throughout the descriptions.

The fin 1 according to an embodiment of the present invention will be described in detail below with reference to FIGS. 1-5, in which the heat exchanger is a micro-channel heat exchanger. However, a person skilled in the art will understand that the heat exchanger employing the fin is not limited to a micro-channel heat exchanger.

Figure 2:
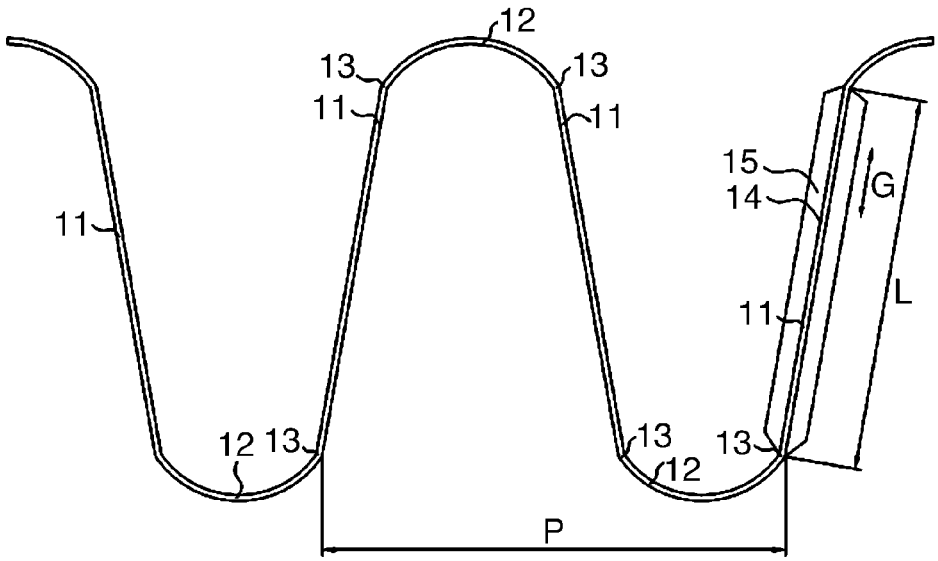
FIG. 2 is a side view of a part of the fin of FIG. 1 according to the embodiment of the present invention.

FIG. 1 is a perspective view of a part of the fin 1 before the fin 1 is assembled and welded to the micro-channel heat exchanger. FIG. 2 is a side view of the part of the fin 1 shown in FIG. 1, and FIG. 3 is a partial enlarged view of the part of the fin 1 shown in FIG. 2.

Figure 3:
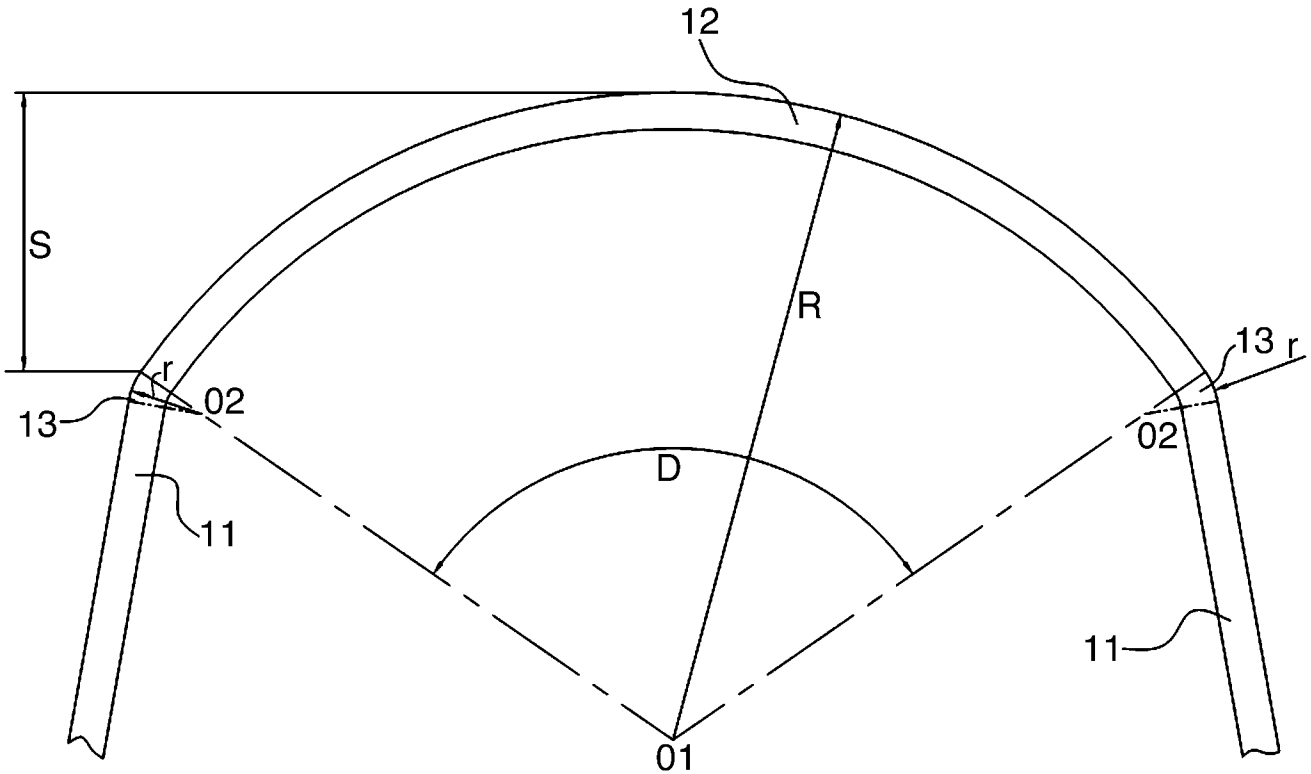
FIG. 3 is an enlarged view of the part of the fin shown in FIG. 2.

As shown in FIGS. 1-3, the fin 1 has a corrugated shape, i.e. a sinusoidal shape, and comprises a straight segment 11, a substantially-circular arc segment 12 and a substantially-circular arc transition segment 13 connected between the straight segment 11 and the substantially-circular arc segment 12. It should be understood that FIGS. 1-3 only show a part of the fin 1 and the fin 1 can be extended with any desired length in the right and left directions in FIG. 2.

As shown in FIG. 2, both ends of the substantially-circular arc segment 12 are connected to first ends of two substantially-circular arc transition segments 13, and second ends of the two substantially-circular arc transition segments 13 are connected to first ends of two straight segments 11 respectively. Next, second ends of the two straight segments 11 are connected to second ends of another two substantially-circular arc transition segments 13, thereby the corrugated fin 1 being formed accordingly. In other words, the straight segments 11, the substantially-circular arc transition segments 13 and the substantially-circular arc segments 12 are connected in turn in the extending direction of the fin 1. In the above example, the fin 1 comprises two straight segments 11, two the substantially-circular arc segments 12 and four substantially-circular arc transition segments 13. In other words, two straight segments 11, two the substantially-circular arc segments 12 and four substantially-circular arc transition segments 13 form one cycle of the fin 1, as shown in FIG. 2, the cycle length of the fin 1 being shown as P. For example, the fin 1 can be formed by metal sheet via milling process. A person skilled in the art will understand that the number of cycles in the fin 1 can be determined as desired.

Figure 4:
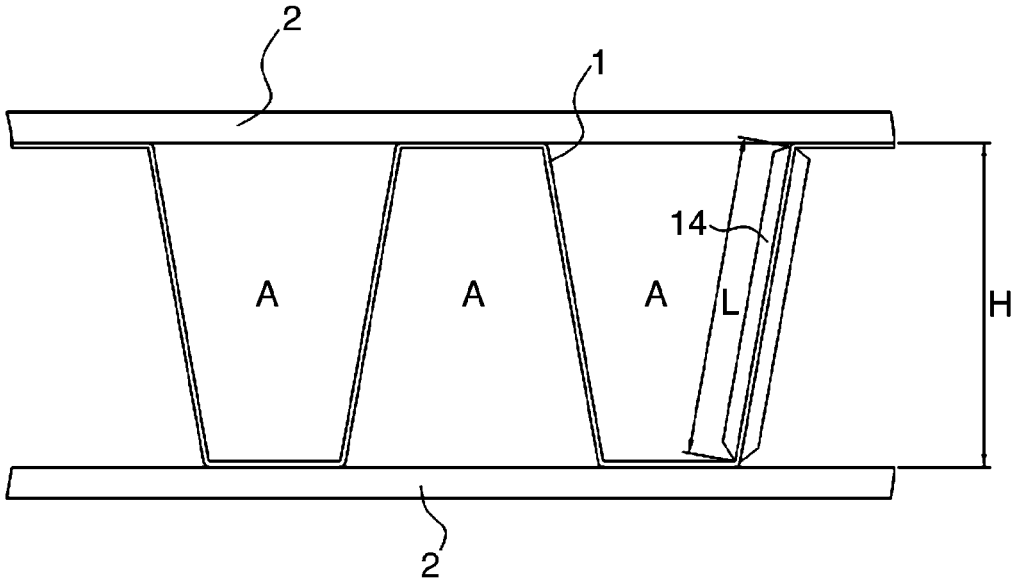
FIG. 4 is a perspective view of a part of a fin according to an embodiment of the present invention after being assembled and welded to a heat exchanger.

In some embodiments of the present invention, as shown in FIG. 3, the radius of each substantially-circular arc segment 12 is R and the radius of the substantially-circular arc transition segment 13 is r, in which R>r. During manufacturing of the heat exchanger, the fin 1 is assembled and pressed between adjacent heat transfer tubes 2 (for example flat tubes of the micro-channel heat exchanger, as shown in FIG. 4). Since R is larger than r, the substantially-circular arc segment 12 is easy to deform such that the substantially-circular arc segment 12 becomes a straight segment and clings to the surfaces of the flat tubes 2, and the shapes of the substantially-circular arc transition segment 13 having a smaller radius r and the straight segment 11 are kept substantially unchanged.

Moreover, the deformation of the respective substantially-circular arc segments 12 is uniform and regular, so that the deformation of the fin 1 is regular and easy to control, and the arranging density of the fin 1 in the heat exchanger is uniform. Therefore, the shape of the fin 1 can meet the design requirements and the shape stability of fin 1 is high. After welding the fin 1 to the tubes 2, the area A surrounded by two adjacent straight segments 11, the straightened substantially-circular arc segment 12 and the flat tubes 2 has a substantially isosceles trapezoid shape and the shapes of the areas A are uniform as shown in FIG. 4. Therefore, the heat transfer coefficient on the air side of the heat exchanger is increased, thus improving the heat transfer performance. Moreover, the appearance of the heat exchanger is tidy.

Figure 5:
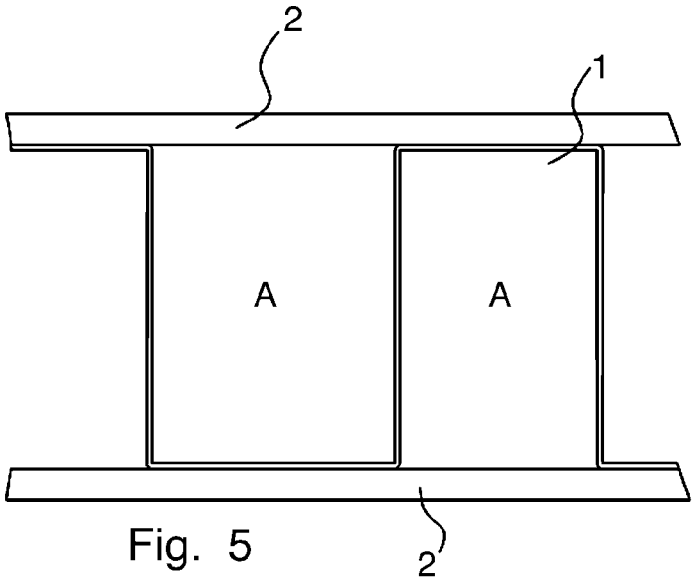
FIG. 5 is a perspective view of a part of a fin according to another embodiment of the present invention after being assembled and welded to a heat exchanger.

As shown in FIG. 5, in some embodiments of the present invention, by changing the size of the substantially-circular arc segment 12, after welding of the fin 1, the area A may have a substantially rectangle or square shape.

In some embodiments of the present invention, the ratio of the radius R of the substantially-circular arc segment 12 to the radius r of the substantially-circular arc transition segment 13, i.e. R/r, is larger than 2, so that the substantially-circular arc segment 12 is easier to deform. Compared to r, the larger R is, the more easily the substantially-circular arc segment 12 deforms. In one embodiment, R is five times r, for example R may be about 1 mm and r may be about 0.2 mm.

As shown in FIG. 3, when the substantially-circular arc segment 12 becomes straight, the compressed distance (i.e., the chord length of the substantially-circular arc segment 12) of the substantially-circular arc segment 12 is s. In some embodiments of the present invention, to manufacture the fin 1 more easily, the compressed distance s may be controlled between about 0.01 mm and about 0.1 mm, in other words, $0.01\text{ mm} \le R(1-\cos(\alpha/2)) \le 0.1\text{ mm}$, in which a is the central angle of the substantially-circular arc segment 12. Similarly, in one embodiment of the present invention, in order to manufacture the fin 1 more conveniently, the central angle a of the substantially-circular arc segment 12 may be set as $30° \le \alpha \le 160°$.

In some embodiments of the present invention, in order to form the shape of area A regular after assembling and welding the fin 1 to the flat tubes 2 of the heat exchanger, for example, to form the area A to have a rectangle or isosceles trapezoid shape or a similar shape, the relational expression $(2\times R\times\alpha\times\pi/180)/P>0.85$ is satisfied, in which R is the radius of the substantially-circular arc segment 12, P is one cycle length of the fin 1, $\alpha$ is the central angle of the substantially-circular arc segment, and $\pi$ is circumference ratio. The cycle length P of the fin 1 is the length of a straight line segment between two points on the fin 1 having the same phase. For example, as shown in FIG. 2, the cycle length P is the straight line distance between the lower ends of the two straight segments 11 which are inclined upwardly and rightward, or the straight line distance between the vertexes of two adjacent substantially-circular arc segments 12.

As shown in FIGS. 1-2 and 4, in some embodiments of the present invention, the deformation of the fin 1 is realized through the deformation of the substantially-circular arc segment 12 (that is, the substantially-circular arc segment 12 becomes straight), and the straight segment 11 does not substantially deform, therefore, a window 14 may be formed in the straight segment 11 so as to increase the heat transfer coefficient of the fin 1 and heat exchanging performance of the heat exchanger. In some embodiments of the present invention, the window 14 is formed by extending a portion 15 of the straight segment 11 away from a plane in which the straight segment 11 is located. For example, the portion 15 may be extended away from the straight segment 11 by punching process. Alternatively, the window 14 may be formed by cutting a slot in the straight segment 11, then turning the portion 15 from the straight segment 11 through punching process, in which the portion 15 is still connected to the straight segment 11, so that the heat transfer coefficient of the fin 1 and heat transfer performance of the heat exchanger may be further improved.

In some embodiments of the present invention, as shown in FIG. 2, considering the manufacturability and the resistance on the air side of the fin 1, the relationship between the length L of the window 14 and the height H of the fin 1 satisfies $0.85\leq L/H\leq 1.05$. It should be noted that the length L is the length of the window 14 in the longitudinal direction (direction indicated by arrow G in FIG. 2) of the straight segment 11, and the height H is the height of the fin 1 in the vertical direction (up and down direction in FIG. 4) after the fin 1 is welded to the tubes 2 and deformed, as shown in FIGS. 2 and 4. In other words, the height of the fin 1 is the distance between an upper straight substantially-circular arc segment 12 and a lower straight substantially-circular arc segment 12 after the straight substantially-circular arc segments 12 become straight, as shown in FIG. 4.

The heat exchanger according to an embodiment of the present invention will be described with reference to FIGS. 6 and 7 below. In the following descriptions, the heat exchanger is described as a micro-channel heat exchanger, but the present invention is not limited to this.

Figure 6:
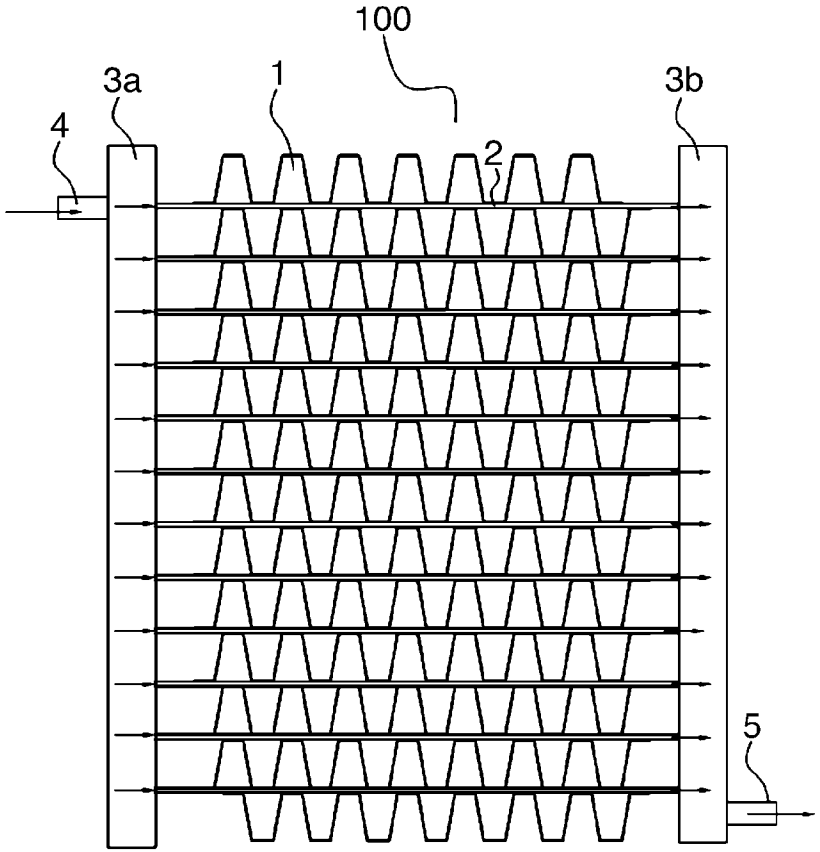
FIG. 6 is a schematic view of a heat exchanger according to an embodiment of the present invention.

FIG. 6 shows a micro-channel heat exchanger 100 having a single flow path. The micro-channel heat exchanger 100 comprises a first header 3*a*, a second header 3*b*, flat tubes 2 and fins 1.

The first header 3*a* is formed with an inlet 4 and the second header 3*b* is formed with an outlet 5. Of course, a person skilled in the art can understand that the outlet 5 will be formed in the first header 3*a* when the micro-channel heat exchanger 100 has even numbered flow path (as shown in FIG. 7).

Two ends of each flat tube 2 is connected to the first header 3*a* and the second header 3*b* such that the first header 3*a* communicates with the second header 3*b* by a plurality of micro-channels in the flat tube 2. Each fin 1 is disposed between two flat tubes 2, for example, the fin 1 is welded to the flat tubes 2. The fin 1 comprises a straight segment 11, a substantially-circular arc segment 12 and a substantially-circular arc transition segment 13 connected between the straight segment 11 and the substantially-circular arc segment 12. The radius of each substantially-circular arc segment 12 is R and the radius of the substantially-circular arc transition segment 13 is r, in which R>r.

As shown in FIG. 6, since R is larger than r, the substantially-circular arc segment 12 is easy to deform. During assembling of the fin 1, the substantially-circular arc segment 12 is pressed between the flat tubes 2 and becomes straight, and the shapes of the substantially-circular arc transition segment 13 having a smaller radius r and the straight segment 11 are kept substantially unchanged.

After welding of the fin 1, the area A surrounded by two adjacent straight segments 11, the straightened substantially-circular arc segment 12 and the flat tubes 2 has a substantially isosceles trapezoid shape, and the shapes of the areas A are uniform. Therefore, the fin 1 is arranged uniformly in the micro-channel heat exchanger 100 and the shape of the fin 1 can meet the design requirements. In addition, the shape stability of the fin 1 is high and the heat transfer coefficient on the air side is increased, thus improving the heat transfer performance of the micro-channel heat exchanger 100.

A micro-channel heat exchanger 100 according to another embodiment of the present invention will be described with reference to FIG. 7 below. Compared to the micro-channel heat exchanger 100 shown in FIG. 6, in the micro-channel heat exchanger 100 shown in FIG. 7, partition plates 6 are disposed in the first header 3*a* and the second header 3*b* respectively, so that the micro-channel heat exchanger 100 becomes a multi-flow path heat exchanger 100. In FIG. 7, the micro-channel heat exchanger 100 has four flow paths. Therefore, both the inlet 4 and the outlet 5 are formed in the first header 3*a*.

Here, the term "flow path" is a path along which the fluid in the flat tube flows in one direction from one header to another header (FIG. 6 shows a micro-channel heat exchanger having one flow path. When the micro-channel heat exchanger 100 has a plurality of flow paths, two adjacent flow paths are connected in series via a connection flow path (for example the connection flow path 31 in FIG. 7) in one header, and the flowing directions of the fluid in two adjacent flow paths are substantially opposed to each other. It should be noted that one flow path may comprise a plurality of flat tubes and the flowing directions of the fluid in the plurality of flat tubes of one flow path are identical.

Figure 7:
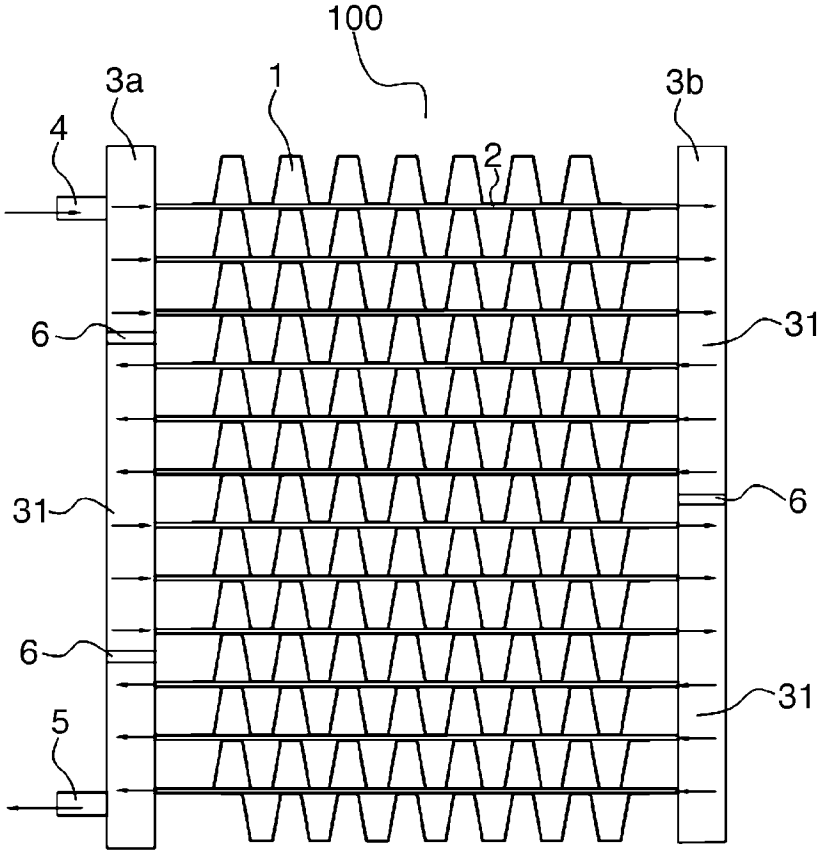
FIG. 7 is a schematic view of a heat exchanger according to another embodiment of the present invention.

As shown in FIG. 7, in the micro-channel heat exchanger 100 having four flow paths, the fluid such as refrigerant flows from the first header 3*a* to the second header 3*b* rightward via three flat tubes 2 (first flow path). Then, the fluid changes its flow direction via the connection flow path 31 in the second header 3*b* so that the fluid flows from the second header 3*b* to the first header 3*a* leftward via three flat tubes 2 (the second flow path). In other words, the first flow path is connected to the second flow path in series via the connection flow path 31 in the second header 3*b*. Next, the fluid changes its flow direction via the connection flow path 31 in the first header 3*a* so that the fluid flows from the first header 3*a* to the second header 3*b* rightward via three flat tubes (the third flow path). Finally, the fluid changes its flow direction via another connection flow path 31 in the second header 3*b* so that the fluid flows from the second header 3*b* to the first header 3*a* leftward via three flat tubes 2 (the fourth flow path), in which the second flow path is connected in series to the third flow path via the connection flow path 31 in the first header 3*a*, and the third flow path is connected in series to the fourth flow path via the another connection flow path 31 in the second header 3*b*. As shown in FIG. 7, there is one connection flow path in the first header 3*a* and there are two connection flow paths in the second header 3*b*.

It is known from the above of the following: in the micro-channel heat exchanger 100, the flow directions of the fluid in the odd numbered flow paths (such as the first flow path, the third flow path) are substantially identical, and the flow directions of the fluid in the even numbered flow paths (such as the second flow path, the fourth flow path) are the substantially identical and opposite to the flow directions of the fluid in the odd numbered flow paths, in which two adjacent flow paths are connected in series via one connection flow path.

The micro-channel heat exchanger 100 shown in FIG. 7 has advantages of the micro-channel heat exchanger 100 shown in FIG. 6. In addition, the micro-channel heat exchanger 100 shown in FIG. 7 has a plurality of flow paths, so that the heat transfer efficiency may be improved.

The heat exchanger assembly according to an embodiment of the present invention will be described with reference to FIGS. 8 and 9.

Figure 8:
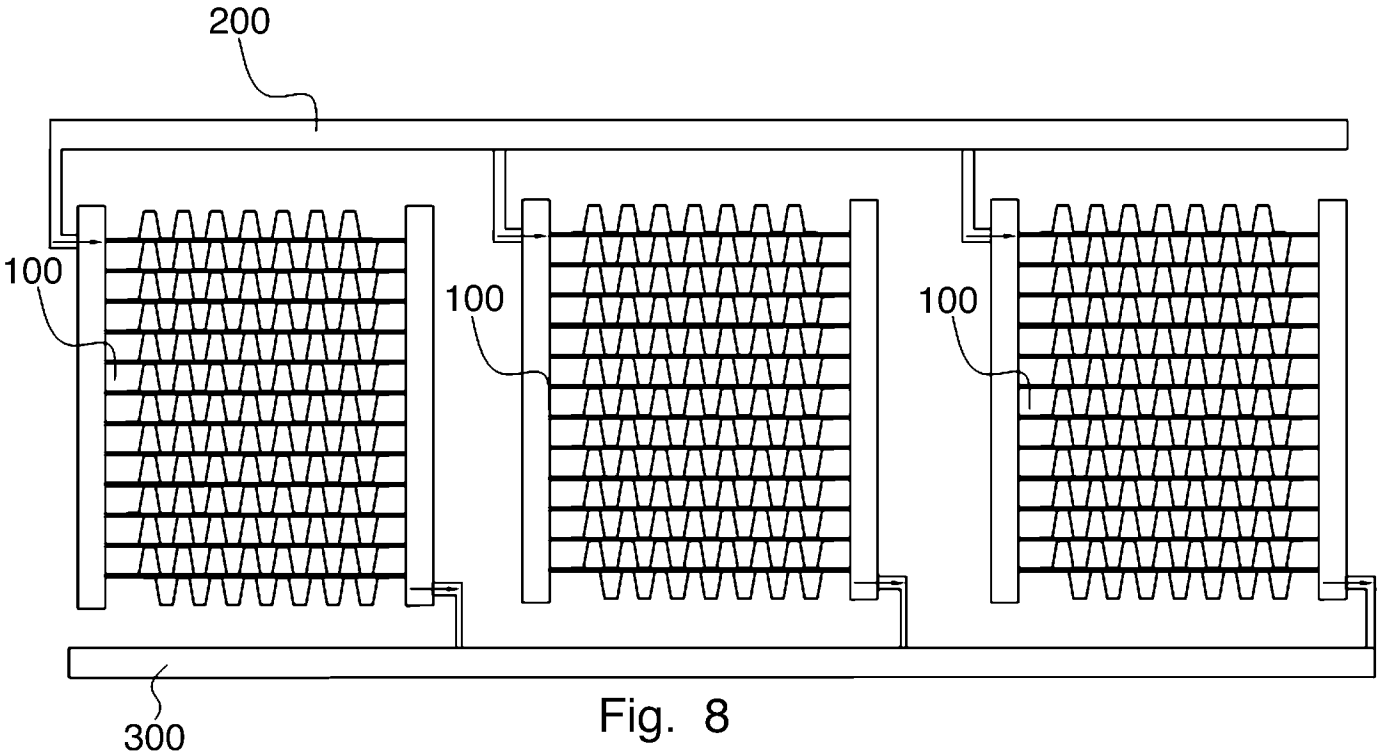
FIG. 8 is a schematic view of a heat exchanger assembly according to an embodiment of the present invention.

As shown in FIG. 8, in some embodiments of the present invention, the heat exchanger assembly may comprise three heat exchangers 100 such as micro-channel heat exchangers. Of course, the number of the heat exchangers 100 in the heat exchanger assembly is not limited to three. Therefore, the heat exchanger assembly comprising a plurality of heat exchangers may be suitable for different conditions.

In the example shown in FIG. 8, the three micro-channel heat exchangers 100 are connected in parallel, that is, the inlets 4 of the three micro-channel heat exchangers 100 are connected to a common fluid supply pipe 200, and the outlets 5 thereof are connected to a common fluid discharge pipe 300. In the example shown in FIG. 9, the heat exchanger assembly comprises three micro-channel heat exchangers 100, in which the three micro-channel heat exchangers 100 are connected in series, that is, the inlet 4 of the second micro-channel heat exchanger 100 is connected to the outlet 5 of the first micro-channel heat exchanger 100, and the outlet of the second micro-channel heat exchanger 100 is connected to the inlet 4 of the third micro-channel heat exchanger 100.

Figure 9:
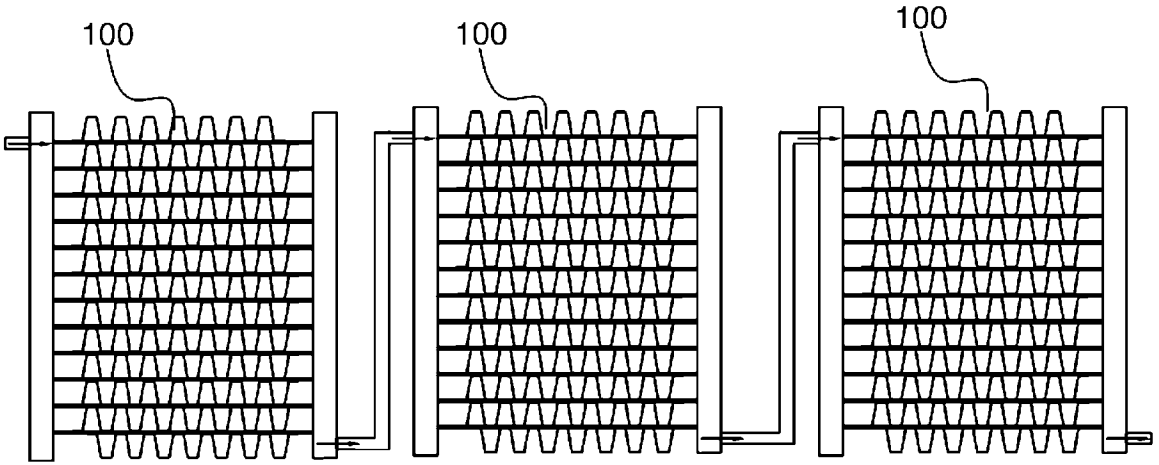
FIG. 9 is a schematic view of a heat exchanger assembly according to another embodiment of the present invention.
Figure 10:
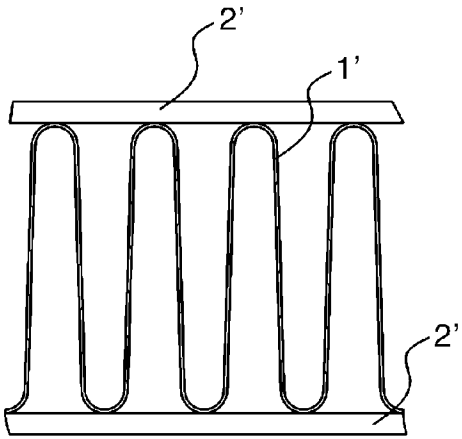
FIG. 10 is a schematic view of a conventional fin before being assembled and welded to a heat exchanger.
Figure 11:
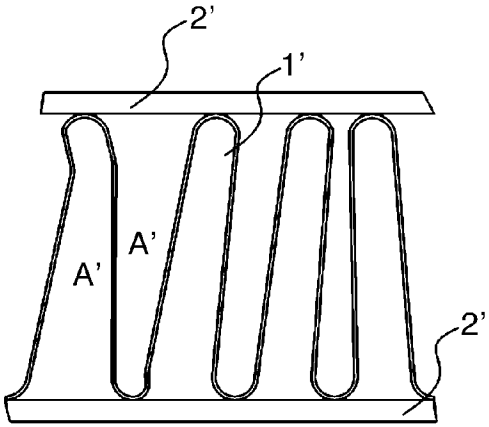
FIG. 11 is a schematic view of the conventional fin of FIG. 10 after being assembled and welded to the heat exchanger.

In the embodiments shown in FIGS. 8 and 9, the three micro-channel heat exchangers 100 are parallel to each other. A person skilled in the art can understand that the micro-channel heat exchangers 100 of the heat exchanger assembly may be disposed with two adjacent micro-channel heat exchangers 100 forming an angle. In addition, in the plurality of the micro-channel heat exchangers 100 of the heat exchanger assembly, some micro-channel heat exchangers 100 may be connected in parallel and the other micro-channel heat exchangers 100 may be connected in series. Alternatively, in the plurality of the micro-channel heat exchangers 100 of the heat exchanger assembly, some micro-channel heat exchangers 100 are parallel to each other, and the other micro-channel heat exchangers 100 are disposed with two adjacent micro-channel heat exchangers 100 forming an angle.

Although explanatory embodiments have been shown and described, it would be appreciated by those skilled in the art that changes, alternatives, and modifications can be made in the embodiments without departing from the spirit and principles of the invention. Such changes, alternatives, and modifications all fall into the scope of the claims and their equivalents.

What is claimed is:

1. A fin for a heat exchanger, comprising:

a straight segment;

a substantially-circular arc segment having a radius of R; and a substantially-circular arc transition segment connected between the straight segment and the substantially-circular arc segment and having a radius of r, wherein R>r; and wherein:

$$0.01\text{ mm} \le R(1-\cos(\alpha/2)) \le 0.1\text{ mm},$$

where: $\alpha$ is a central angle of the substantially-circular arc segment.

2. The fin for a heat exchanger according to claim 1, wherein R/r>2.

3. The fin for a heat exchanger according to claim 1, wherein $$(2\times R\times\alpha\times\pi/180)/P \ge 0.85,$$

where:

P is one cycle length of the fin, $\alpha$ is a central angle of the substantially-circular arc segment, and $\pi$ is circumference ratio.

4. The fin for a heat exchanger according to claim 1, wherein $30° \le \alpha \le 160°$, where: $\alpha$ is a central angle of the substantially-circular arc segment.

5. The fin for a heat exchanger according to claim 1, wherein the straight segment is formed with a window.

6. The fin for a heat exchanger according to claim 5, wherein the window is formed by extending a portion of the straight segment away from a plane in which the straight segment is located.

* * * * *

UNITED STATES PATENT AND TRADEMARK OFFICE

CERTIFICATE OF CORRECTION

PATENT NO. : 8,656,986 B2
APPLICATION NO. : 12/759242
DATED : February 25, 2014
INVENTOR(S) : Gao Yuan and Lin-jie Huang It is certified that error appears in the above-identified patent and that said Letters Patent is hereby corrected as shown below:

Title Page, item (73)

Please correct the Assignee listed on the patent, namely,

Danfoss Sanhua (Hangzhou) Micro Channel Heat Exchanger Co., Ltd., Zhejiang (CN)

To read

Sanhua Holding Group Co. Ltd., Zhejiang (CN); and
Danfoss A/S Nordborg (DK)

Signed and Sealed this
Twenty-third Day of February, 2016

Michelle K. Lee

Michelle K. Lee
*Director of the United States Patent and Trademark Office*